United States Patent [19]

Lehmann et al.

[11] Patent Number: 4,865,318

[45] Date of Patent: Sep. 12, 1989

[54] BALL TOSSING DEVICE

[76] Inventors: Roger W. Lehmann, 18 Flintlock Ct., Bernardsville, N.J. 07924; Michael I. Satten, 4 Farmers Rd., Kingspoint, N.Y. 11024

[21] Appl. No.: 232,598

[22] Filed: Aug. 15, 1988

[51] Int. Cl.[4] ..... A63B 69/40

[52] U.S. Cl. ..... 273/26 R; 124/16; 124/37

[58] Field of Search ..... 273/26 R, 29 A, 428; 124/16, 37, 34, 10, 36; 446/177, 308; D21/210

[56] References Cited

U.S. PATENT DOCUMENTS

| | | | |
|---|---|---|---|
| 3,627,319 | 12/1971 | Skyhawk | 273/26 R |
| 4,402,507 | 9/1983 | Hudson | 273/26 R |
| 4,778,177 | 10/1988 | Taksony | 273/26 R |

*Primary Examiner*—T. Brown

*Attorney, Agent, or Firm*—Salter & Michaelson

[57] ABSTRACT

A ball tossing device includes a tossing mechanism and a foot pedal assembly which is manually depressible for actuating the tossing mechanism to toss a ball upwardly into the air so that it can be hit with a bat. The tossing mechanism includes a timer assembly which delays the ball tossing action of the device by a predetermined delay interval so that a batter can assume a fully ready position before the ball is tossed into the air.

7 Claims, 4 Drawing Sheets

BALL TOSSING DEVICE

BACKGROUND AND SUMMARY OF THE INVENTION

The instant invention relates to athletic equipment and more particularly to a ball tossing device which is operative for tossing a ball, such as a baseball, into the air so that it can be hit with a baseball bat during a batting practice exercise.

Various baseball related athletic activities have been found to be highly popular with persons in a wide range of age groups. For example, activities, such as games of catch and batting practice exercises, have generally been found to be highly popular. However, heretofore, in many instances it has not been possible for persons to individually perform baseball-related activities without other active participants. In this connection, even though devices, such as pitching machines and ball tossing devices, have been heretofore available, the heretofore available devices of this type have generally either been relatively expensive or they have generally been somewhat awkward to operate, and hence they have been less than entirely satisfactory.

The instant invention provides a ball tossing device which is both simple to operate and adapted for relatively inexpensive constructions. Specifically, the ball tossing device of the subject invention comprises a housing or base which is receivable on a supporting surface, a manually depressible foot pedal on the base, means on the base for receiving a ball and for positioning it at a tossing station, and tossing means which is actuatable by manually depressing the foot pedal for automatically tossing a ball located at the tossing station into the air substantially upon the expiration of a predetermined delay interval. The tossing means preferably includes a resilient spring which is mounted so that it can be manually loaded to actuate the tossing means by depressing the foot pedal, and the tossing means is preferably constructed so that the spring is automatically released substantially upon the expiration of the predetermined delay interval in order to toss a ball into the air. The tossing means preferably further comprises a mechanical timer which is driven by the spring and operative for delaying the release of the spring until the expiration of the predetermined delayed interval. The timer preferably includes an escapement gear which is rotatable between engaged and disengaged positions, and a pendulum arm which communicates with the escapement gear as the latter is moved toward the disengaged position thereof in order to control the rate of advancement of the escapement gear. The escapement gear is biased by the spring toward the disengaged position thereof, and it is operative for releasing the spring to toss a ball located at the tossing station upwardly when the escapement gear reaches the disengaged position thereof. The tossing means preferably further includes a ring support for receiving and supporting a ball at the tossing station, and the ring support is preferably propelled rapidly upwardly a predetermined distance by the spring in order to toss a ball into the air when the spring is released. The receiving means preferably comprises a basket member on the base, which is operative for receiving a ball and for positioning it at the tossing station upon actuation of the tossing means, and the device preferably further comprises a holder member on the basket member which is operative for holding a supply of balls adjacent the upper edge of the basket member so that the balls can be individually moved into the basket member as needed.

It has been found that the ball tossing apparatus of the instant invention can be effectively utilized for tossing balls into the air during batting practice exercises. In this connection, the ball tossing apparatus of the subject invention includes a controlled delay mechanism for delaying the tossing action by a predetermined delay interval after the foot pedal has been depressed. Accordingly, a batter can depress the foot pedal and then assume a ready batting position before the ball is tossed into the air so that the batter can take a full controlled swing at the ball. Further, the apparatus of the subject invention is adapted for relatively simple and inexpensive constructions so that it can be readily adapted for use by small children to perform batting practice exercises.

Devices representing the closest prior art to the subject invention of which the applicant is aware are disclosed in the U.S. Pat. Nos. to TOPP, No. D-281,891; MOORE, No. 2,664,077; SCHENSTED, No. 2,705,003; GOLDFARB et al, No. 3,526,991; COLEMAN, No. 3,792,861; PAYNE, No. 3,856,300 and HUDSON, No. 4,402,507. However, while these references disclose a number of different types of apparatus for tossing balls into the air, they fail to disclose a ball tossing device which is simple and easy to operate and adapted for tossing a ball into the air upon the expiration of a predetermined delay interval, and hence they are believed to be of only general interest with respect to the ball tossing device of the subject invention.

Accordingly, it is a primary object of the instant invention to provide an effective ball tossing apparatus for use in connection wit baseball batting exercises.

Another object of the instant invention is to provide a ball tossing apparatus which is operative for tossing a ball into the air after a predetermined delay interval.

An even further object of the instant invention is to provide an effective ball tossing apparatus which is adapted for relatively inexpensive constructions.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
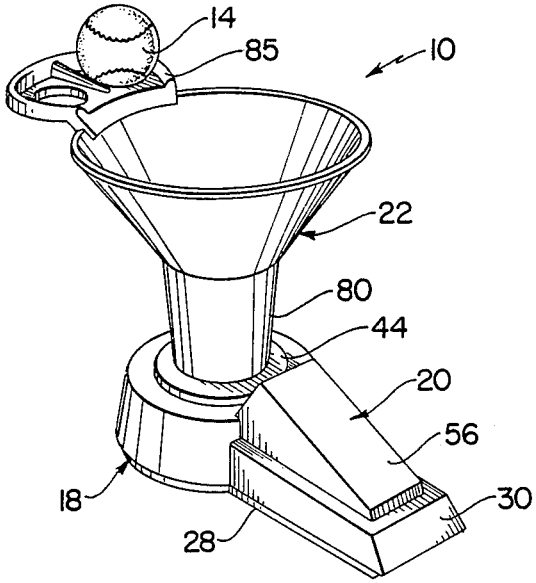
FIG. 1 is a perspective view of the ball tossing apparatus of the instant invention.
Figure 2:
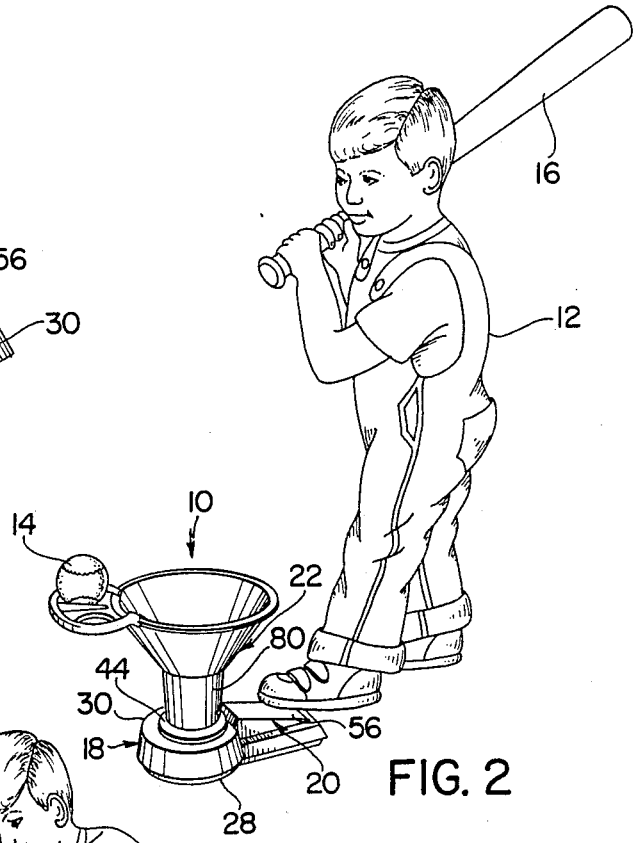
FIGS. 2 and 3 are sequential views illustrating the operation of the ball tossing apparatus.
Figure 3:
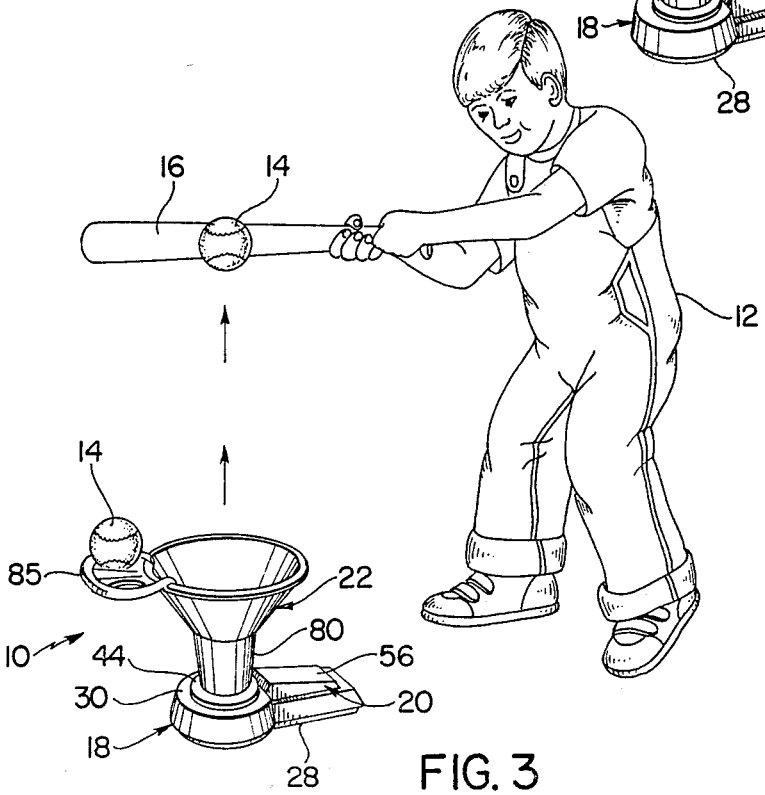
Figure 4:
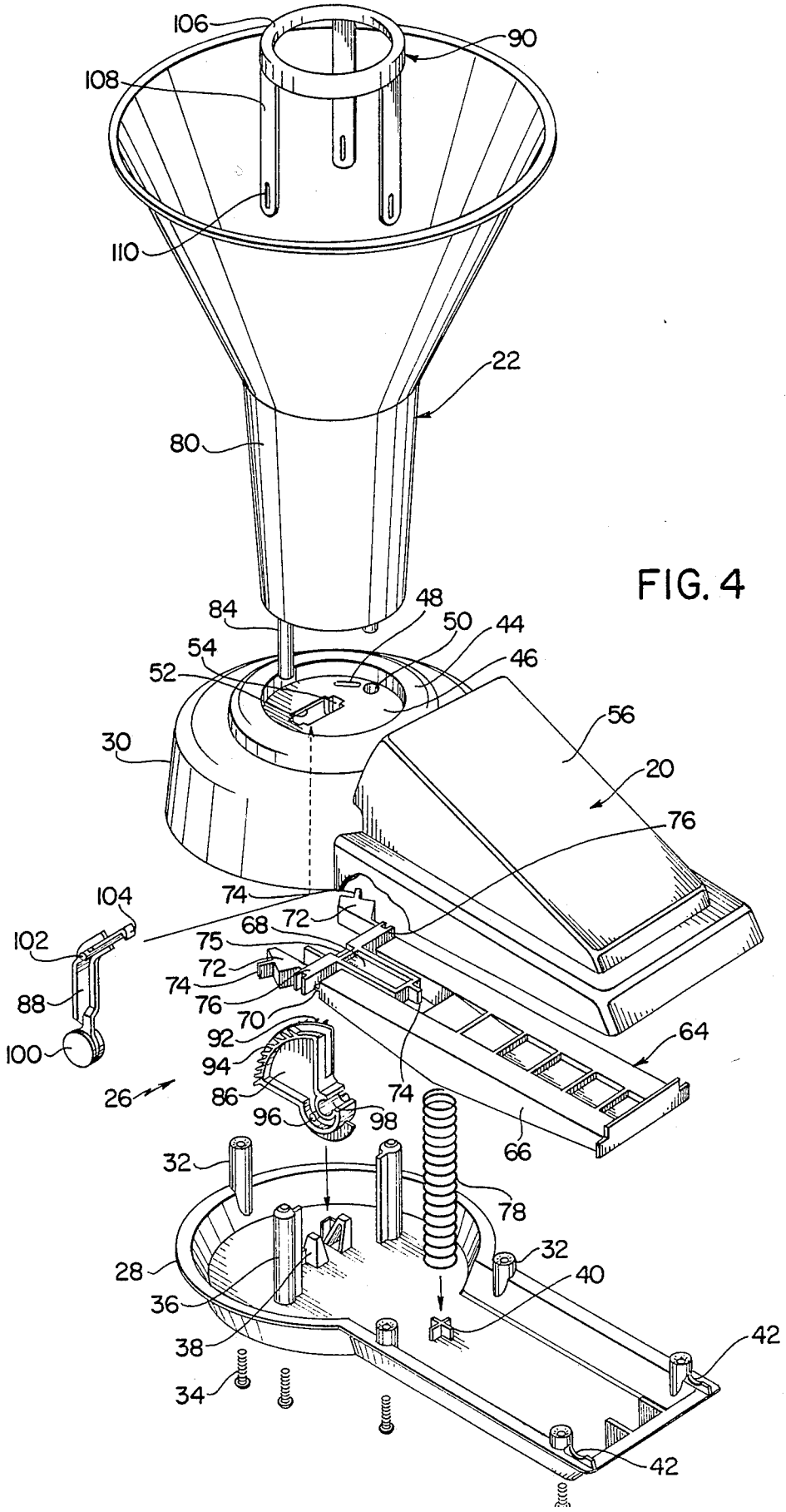
FIG. 4 is an exploded perspective view of the ball tossing apparatus.
Figure 5:
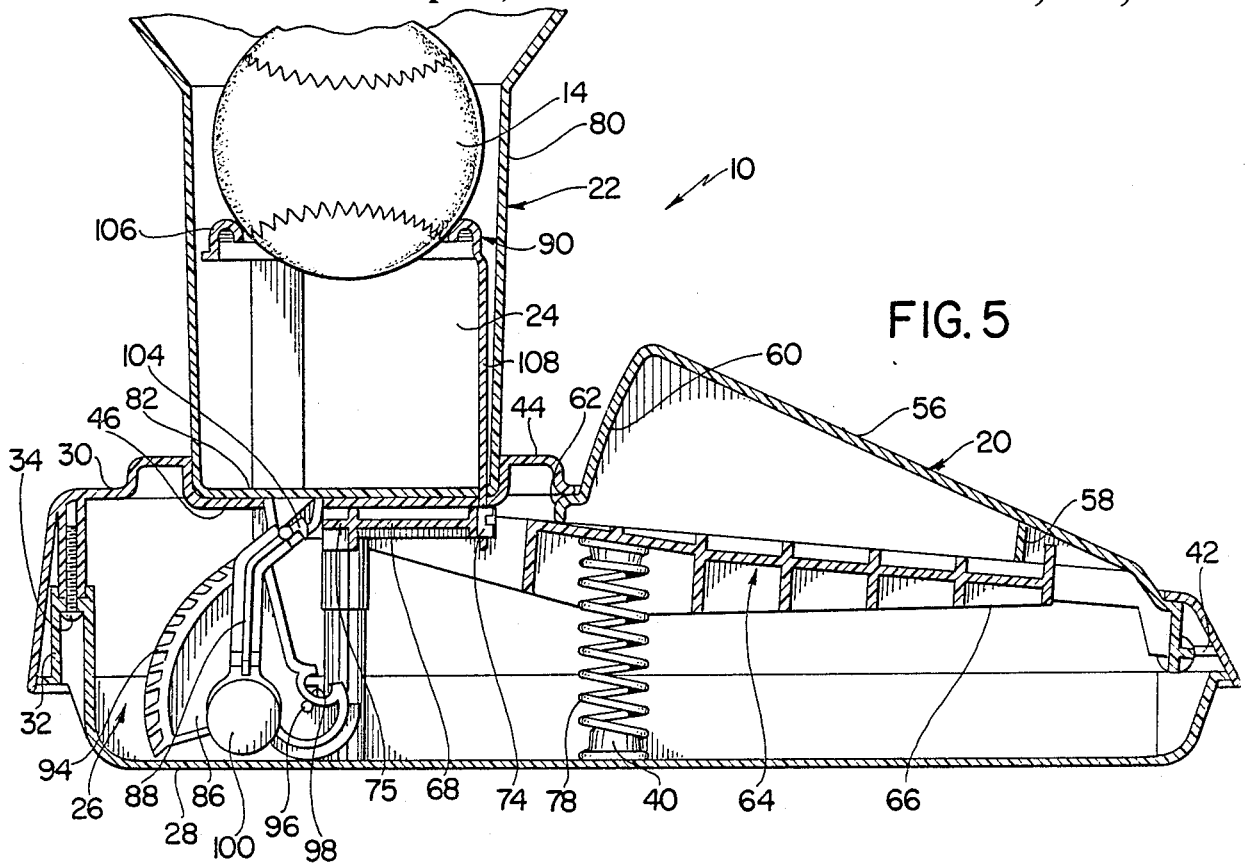
FIGS. 5–8 are sequential sectional views illustrating the operation of the ball tossing apparatus.

Referring now to the drawings, the ball tossing apparatus of the instant invention is illustrated and generally indicated at 10 in FIGS. 1–8. As illustrated in FIGS. 2 and 3, the ball tossing apparatus 10 is operative by an operator 12 for tossing a ball 14 into the air so that the operator 12 can hit the ball 14 with a baseball bat 16. In this connection, however, the ball tossing apparatus 10 is adapted so that it is only operative for tossing the ball 14 into the air after the expiration of a predetermined delay interval so that the operator 12 can assume a ready position before the ball 14 is tossed and then hit the ball 14 with a more controlled natural baseball swing.

The apparatus 10 comprises a base generally indicated at 18, a foot pedal generally indicated at 20 on the base 18, a receiving assembly generally indicated at 22 on the base 18 having a tossing station 24 adjacent the lower end thereof, and a tossing mechanism generally indicated at 26. The apparatus 10 is operative by placing a ball 14 in the receiving assembly 22, and then manually depressing the foot pedal 20 to actuate the tossing mechanism 26 so that the ball 14 gravitates to the tossing station 24. Thereafter, upon the expiration of a predetermined delay interval, the tossing mechanism 26 is released and the ball 14 is tossed into the air so that it can be hit with the bat 16.

The ball 14 as herein embodied preferably comprises a relatively soft padded, fabric covered ball which is adapted for use by relatively young children, and the bat 16 preferably comprises a relatively light-weight hollow plastic bat. It will be understood, however, that the apparatus 10 can be effectively adapted for use with other types of balls, such as those which require the use of a conventional wooden baseball bat.

The base 18 comprises a hollow structure which is preferably made from a suitable plastic material, and it includes a lower shell portion 28 which is adapted to be received on a supporting surface, and an upper portion 30 which is receivable on the lower portion 28 so that it cooperates therewith to define a housing for the tossing mechanism 26. The lower shell portion 28 includes a plurality of upwardly extending posts 32 which are adapted for receiving screws 34 therein in order to secure the upper shell portion 30 to the lower shell portion 28. The lower shell portion 28 further includes a plurality of track posts 36 having upwardly extending tracks along the inner sides thereof. A pair of spaced pivot mounting arms 38 extend upwardly from the lower portion 28, and a spring mount 40 also extends upwardly from the lower portion 28. A pair of spaced pedal mounts 42 are formed in the lower shell portion 28 adjacent one end thereof. The upper shell portion 30 has an upwardly facing ring 44 formed on the upper side thereof which defines the perimeter of an upwardly facing center plate 46. Three uniformly spaced slots 48 are provided in the plate 46 adjacent the perimeter thereof, and a pair of circular apertures 50 are also formed in the plate 46 adjacent the perimeter thereof. Formed in the central portion of the plate 46 is an opening 52, and a pair of spaced pendulum mounting arms 54 are formed on the underside of the plate 46 adjacent the opening 52.

The foot pedal 20 includes a generally rectangular upper pedal member 56 which is pivotably mounted at one end thereof in the pedal mounts 42 so that it is manually depressible for actuating the tossing mechanism 26, as will hereinafter be more fully set forth. The upper pedal member 56 includes a downwardly extending partition 58 on the underside thereof and an end wall 60 at the inner end thereof which terminates in a bottom foot 62. Further included in the foot pedal assembly 20 is a lower pedal member generally indicated at 64 which is located in the interior of the base 18 beneath the upper pedal member 56. The lower pedal member 64 comprises an elongated frame portion 66, and an actuator portion 68 which is hingeably attached to the frame portion 66 with a living hinge 70. The actuator portion 68 includes three outwardly extending arm 72 having outwardly extending tabs 74 on the outer ends thereof, and a central tongue 75. The actuator portion 68 further includes a pair of opposed, outwardly facing female track sections 76 which are received on the tracks on the inner sides of the track posts 36 for mounting the actuator portion 68 so that it is vertically slidable along a predetermined path and maintained in a substantially horizontal disposition. However, because the actuator portion 68 is hingeably connected to the frame portion 66 with the living hinge section 70, the frame portion 66 is free to pivot as it moves up and down in the base 18. The frame portion 66 is positioned beneath the upper pedal member 56 so that the foot 62 and the partition 58 are engageble with the frame portion 66 to move the lower pedal member 64 downwardly, and a coil spring 78 is received on the spring mount 40 so that it engages the underside of the lower pedal portion 64 to bias it upwardly. Accordingly, when the upper pedal member 56 is manually depressed, the lower pedal member 64 is moved from the position illustrated in FIG. 5 to the position illustrated in FIG. 6.

The receiving assembly 22 comprises a receiving member 80 which is of generally funnel-shaped configuration, although it has a substantially closed bottom end wall 82 through which three substantially uniformly spaced, downwardly extending, peripheral slots (not shown) extend. The lower portion of the receiving member 80 is of generally tubular configuration, and a pair of spaced cylindrical legs 84 extend downwardly from the bottom end wall 82. The receiving member 80 is received on the upper portion 30 of the base 18 so that the legs 84 extend through the apertures 50 and so that the bottom end wall 82 is received on the plate 46. When the receiving member 80 is assembled on the upper portion 30 of the base 18 in this manner, the slots (not shown) in the bottom end wall 82 are substantially aligned with the slots 48 in the plate 46, and the posts 84 engage the upper ends of the track post 36 on the lower base portion 28. Screws 34 are received in the track post 36 and threadedly received in the posts 84 to secure the receiving assembly 22 on the base 18. The receiving assembly 22 further comprises a ball rack 85 which is secured to the receiving member 80 adjacent the upper edge thereof and operative for holding a supply of two balls 14 so that they can be easily moved into the receiving member 80 as needed.

The tossing mechanism 26 is mounted in the interior of the base 18, and it comprises the coil spring 78, an arcuate escapement gear 86, a pendulum member 88, and a ring support 90. The escapement gear 86 includes a pair of substantially parallel, arcuate gear segments 92 and 94 which extend over an arc of approximately 90° and have oppositely angled gear teeth thereon. The escapement gear 86 further comprises a pair of outwardly extending pins 96 which are pivotably received in the mounting arms 38 for pivotably mounting the escapement gear 86 in the housing 18. A radially opening slot 98 is also formed in the escapement gear 86 adjacent the pins 96. The pendulum member 88 is of generally elongated configuration and it includes a weighted element 100 at one end thereof, and an pair of pivot pins 102 which extend outwardly from opposite side of the pendulum member 88 adjacent the opposite end thereof. A pair of oppositely angled spaced teeth 104 are also formed on the pendulum member 88 adjacent the end thereof opposite the weighted element 100.

Figure 6:
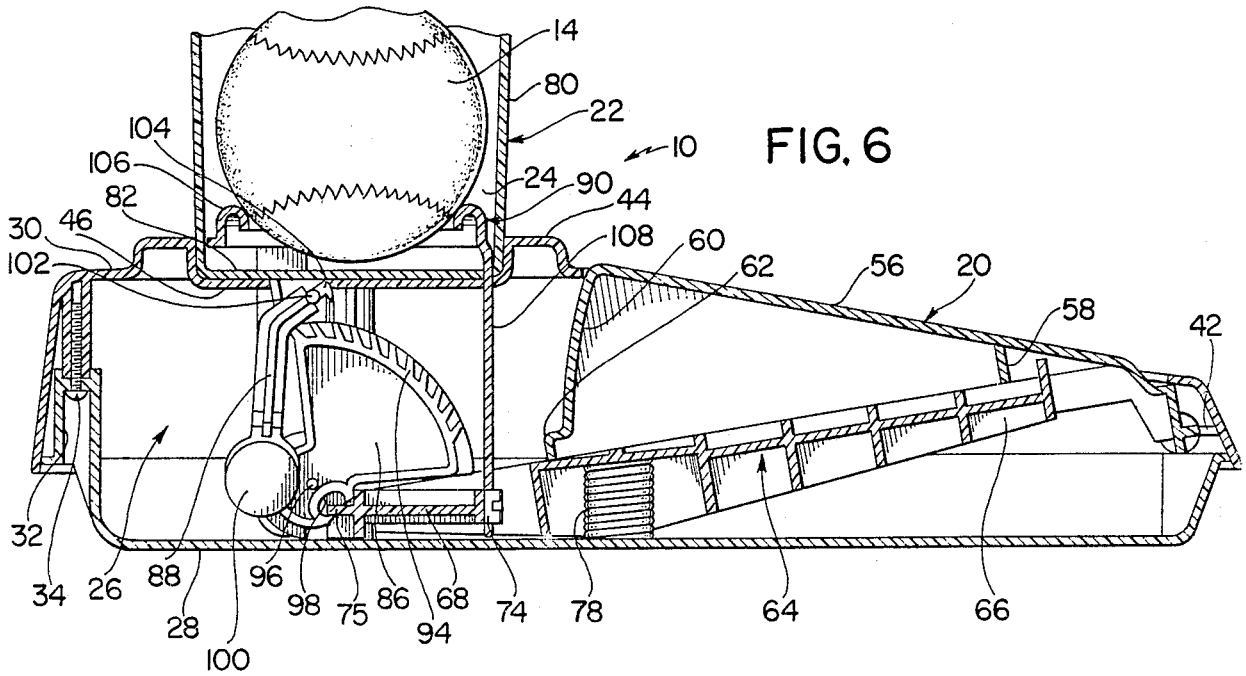
Figure 7:
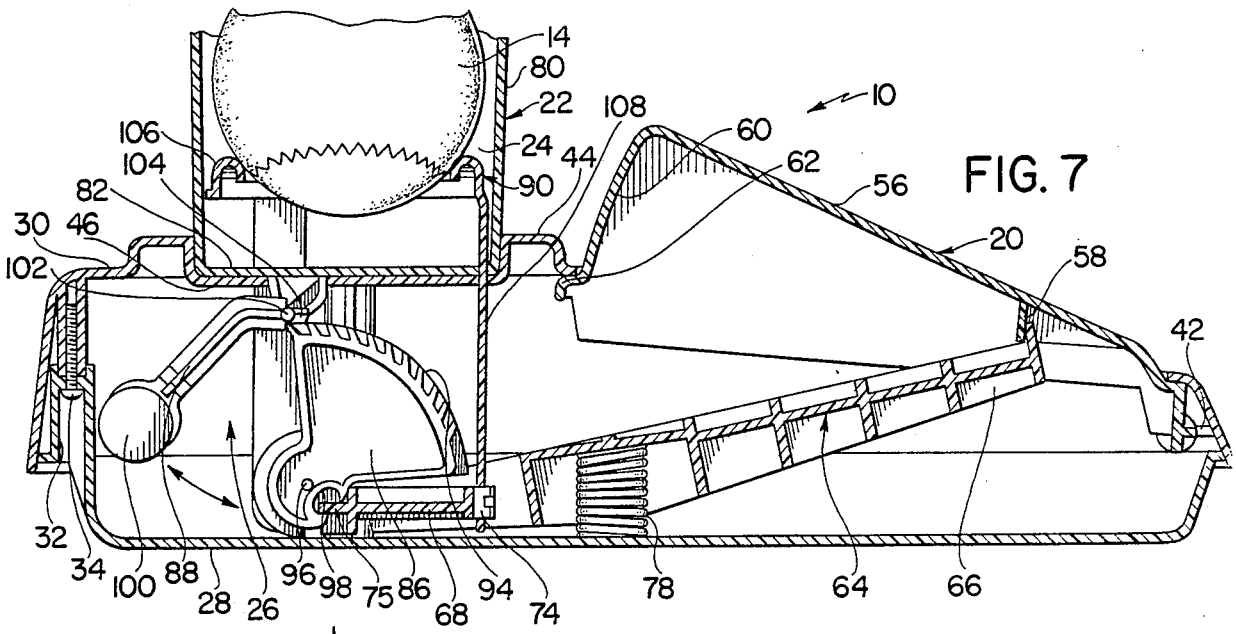
Figure 8:
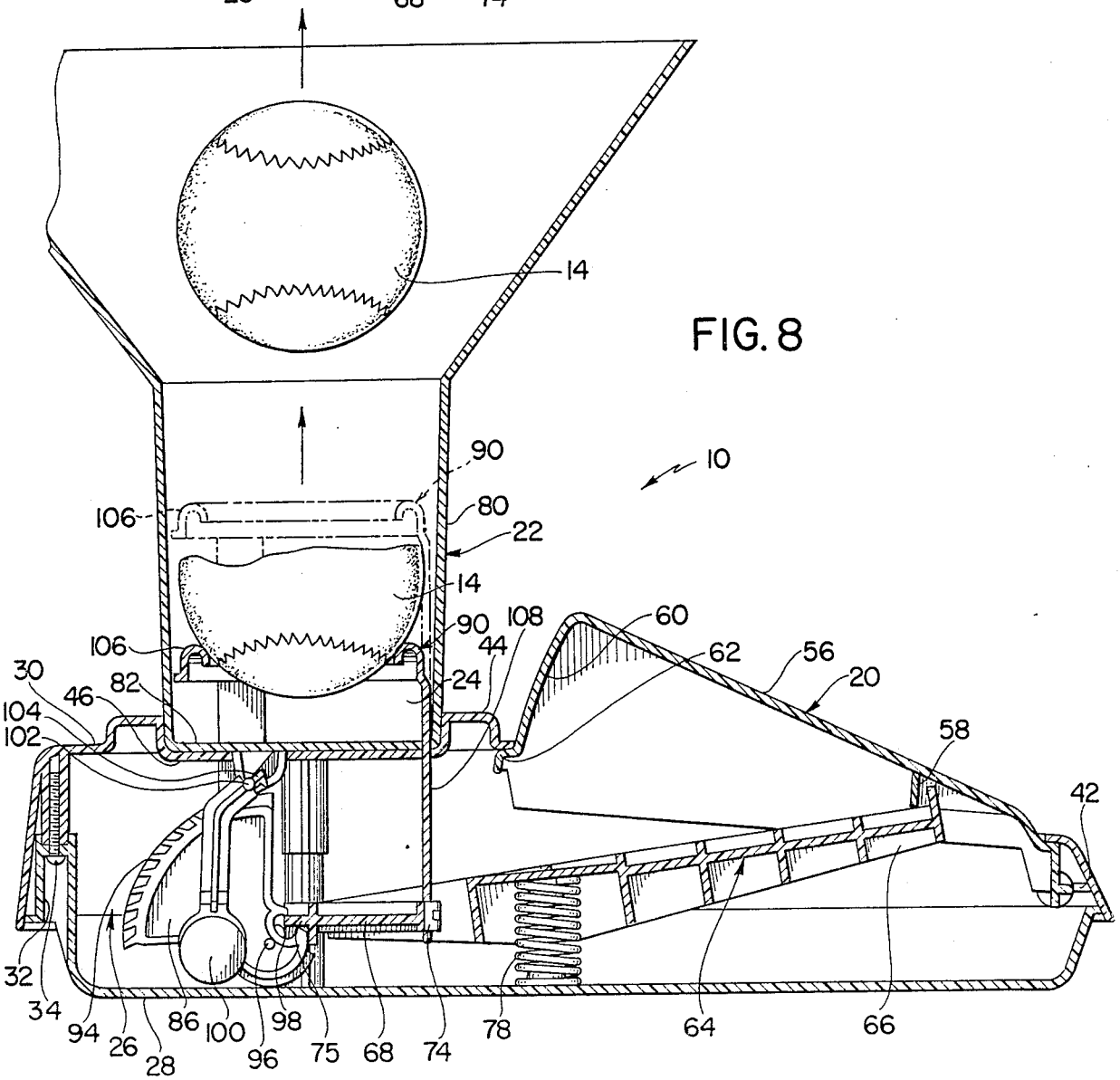

The pins 102 are rotatably received in the mounting arms 54 in the upper portion 30 of the base 18 so that the pendulum element 88 is freely pivotable in the interior of the base 18 and so that each of the teeth 104 is engageable with the gear teeth in a different one of the gear segments 92 and 94 on the escapement gear 86 when the escapement gear 86 is in the engaged position thereof as illustrated in FIGS. 6 and 7. In this regard, as one of the teeth 104 engages the segment 92, the other tooth 104 is disengaged from the segment 94 so that the pendulum element 88 oscillates back and forth as the escapement gear 86 is rotated toward the unactuated or disengaged position illustrated in FIG. 8. This causes the escapement gear 86 to be advanced toward the disengaged position thereof, at a controlled rate, and it also causes it to produce a ticking sound; and hence the escapement gear 86 and the pendulum element 88 in effect cooperate to provide a timer mechanism which defines a predetermined delay interval between the time when the tossing mechanism 26 is initially actuated and the time when a ball 14 positioned at the tossing station 24 is tossed into the air. In this connection, the delay interval provided by the pendulum element and the escapement gear 86 is at least approximately one second and preferably at least approximately three seconds so that a batter 12 can assume a fully ready position before a ball 14 is tossed into the air.

The tossing mechanism 26 further comprises the support ring 90 which is operative for tossing a ball 14 located at the tossing station 24 into the air upon the expiration of the delay interval. The support ring 90 comprises a substantially circular ring portion 106 and three downwardly extending legs 108 having slots 110 therein adjacent the lower ends thereof. The support ring 90 is received in the receiving assembly 22 so that the legs 108 pass downwardly through the slots (not shown)in the bottom end wall 82 and through the slots 48, and the tabs 74 on the actuating portion 68 of the lower pedal member 64 are received in the slots 110 to connect the support ring 90 to the actuator portion 68 of the lower pedal member 64.

For use and operation of the ball tossing device 10, a ball 14 is placed in the receiving assembly 22 so that it is received on the ring element 106. Thereafter the upper pedal member 56 is manually depressed so that it moves the lower pedal member 64 downwardly to compress the spring 78 and to draw the ring element 90 downwardly so that the ball 14 is positioned at the tossing station 24. As the lower pedal member 64 is moved downwardly, the tongue 75 is received in engagement in the slot 98 on the escapement gear 86 so that the escapement gear 16 is rotated from the disengaged position illustrated in FIG. 5 to the engaged position illustrated in FIG. 6. Thereafter, when the downward force on the upper pedal member 56 is released, the spring element 78 urges the lower pedal member 64 upwardly, and this causes the escapement gear 86 to be rotated toward the disengaged position thereof. As the escapement gear 86 is rotated toward the disengaged position thereof, the teeth 104 on the pendulum element 88 engage the teeth in the gear segments 92 and 94 to cause the pendulum element 88 to oscillate back and forth s that the escapement gear 86 to be advanced toward the disengaged position thereof at a controlled rate and a ticking sound is produced from the tossing mechanism 26. Finally, when the escapement gear 86 has been fully advanced to the disengaged position thereof illustrated in FIG. 8, the tongue 75 is released from the slot 98 so that the actuating portion 68 of the lower pedal member 64 is propelled rapidly upwardly by the spring element 78. As this occurs, the support ring 90 is also propelled rapidly upwardly and the ball 14 is thereby tossed into the air. As the spring element 78 is released, the pedal assembly 20 is returned to the unactuated position thereof illustrated in FIG. 5, and the support ring 90 is advanced upwardly a predetermined distance to the position illustrated in FIG. 5. Thereafter, a second ball element 14 can be placed in the receiving assembly 22 so that the apparatus 10 can be operated to toss the second ball element 14 upwardly in a similar manner.

It is seen, therefore, that the instant invention provides an effective ball tossing apparatus. The apparatus 10 is operative for tossing the ball 14 into the air in a manner which enables the batter 12 to easily and effectively hit the ball 14 with the bat 16. In this connection, because the tossing mechanism 26 is operative for tossing the ball 14 into the air only upon the expiration of a predetermined delay interval, the batter 12 can easily and effectively depress the pedal assembly 20 by stepping downwardly thereon, and thereafter assume a ready position before the ball 14 is tossed into the air. As a result, the batter 12 can make a more effective controlled swing at the ball 14, and the batter 12 can gain substantially more effective and natural batting practice exercise. Hence, it is seen that the device of the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A device for tossing a ball into the air comprising:

(a) a base receivable on a supporting surface;

(b) a manually depressible foot pedal;

(c) means on said base defining a tossing station;

(d) receiving means on said base for receiving a ball and for positioning it at said tossing station; and (e) tossing means actuatable by manually depressing said foot pedal for automatically tossing said ball located at said tossing station into air substantially upon the expiration of a predetermined delay interval, said tossing means including spring means, said foot pedal being operative for moving said spring means to a loaded position in order to actuate said tossing means, and timer means defining said predetermined delay interval, said timer means mechanically retaining said spring means in the loaded position during said delay interval and releasing said spring means to an unloaded position upon the expiration of said delay interval, said spring means communicating with said ball located at said tossing station for tossing the latter into the air as said spring means is released to the unloaded position thereof.

2. In the device of claim 1, said delaying interval being at least approximately one second.

3. In the device of claim 1, said tossing means further comprising mechanical timer means driven by said spring means and actuated upon actuation of said tossing means for delaying the release of said spring means to the unloaded position thereof by substantially the amount of said predetermined delay interval.

4. In the device of claim 3, said timer means including an escapement gear rotatable between engaged and disengaged positions, and a pendulum arm communicating with said escapement gear as the latter is moved toward the disengaged position for controlling the rate of advancement of said escapement gear, said escapement gear being biased by said spring means toward said disengaged position and being operative for releasing said spring means upon reaching said disengaged position thereof.

5. In the device of claim 1, said receiving means comprising an upwardly open funnel-shaped basket member on said base.

6. The device of claim 5 further comprising holding means on said basket member for holding a supply of balls adjacent the upper extremity of said basket member so that they are individually movable into said basket member.

7. In the device of claim 1, said tossing means comprising a ring support for receiving said ball and supporting same at said tossing station, said ring support being rapidly propelled upwardly a predetermined distance in order to toss said ball into the air substantially upon the expiration of said delay interval.

* * * * *